United States Patent [19]

Hegel

[11] 3,967,447

[45] July 6, 1976

[54] HYDRAULIC MASTER-SLAVE CLUTCH SYSTEM

[75] Inventor: Robert W. Hegel, Monroe, Mich.

[73] Assignee: Monroe Auto Equipment Company, Monroe, Mich.

[22] Filed: Oct. 25, 1974

[21] Appl. No.: 517,867

[52] U.S. Cl. ..... 60/572; 60/592; 91/422

[51] Int. Cl.[2] ..... F15B 7/10

[58] Field of Search ..... 60/585–589, 60/591, 592, 542, 543, 572; 91/401, 422, 437, 224, 229

[56] References Cited

UNITED STATES PATENTS

| | | | |
|---|---|---|---|
| 204,914 | 6/1878 | Prince, Jr. | 91/422 |
| 1,299,668 | 4/1919 | Blomquist | 91/422 X |
| 2,438,317 | 3/1948 | Gabriel | 60/592 X |
| 2,453,852 | 11/1948 | Milster | 60/572 X |
| 2,531,705 | 11/1950 | Schultz | 60/585 |
| 2,540,879 | 2/1951 | Hebel et al. | 60/572 |
| 2,882,686 | 4/1959 | Griffth | 60/572 |
| 3,025,674 | 3/1962 | Cameron-Johnson | 60/572 |
| 3,059,622 | 10/1962 | Sexauer | 91/401 |
| 3,152,448 | 10/1964 | Mercier | 60/572 |

*Primary Examiner*—Martin P. Schwadron
*Assistant Examiner*—Harold Burks, Sr.
*Attorney, Agent, or Firm*—Harness, Dickey & Pierce

[57] ABSTRACT

A hydraulic clutch system comprising a first piston and cylinder assembly including a piston rod for causing a first piston to move within a first enclosure in response to actuation of a vehicle clutch pedal or the like, a second piston cylinder assembly including a second piston movable within a second enclosure from a non-actuated position to an actuated position to operate a vehicle clutch mechanism, a fluid circuit including a hydraulic conduit communicating fluid from one end of the first enclosure to the second enclosure and operable to bias the second piston from the non-actuated position toward the actuated position, a fluid reservoir communicable with the fluid circuit, and a valve operative in response to preselected movement of one of the pistons within the associated of the enclosures for communicating the reservoir with the conduit.

15 Claims, 4 Drawing Figures

HYDRAULIC MASTER-SLAVE CLUTCH SYSTEM

SUMMARY OF THE INVENTION

Generally speaking, the present invention relates to hydraulic piston and cylinder mechanisms and more particularly, to a new and improved master-slave hydraulically operated vehicular clutch system.

It is accordingly a general object of the present invention to provide a new and improved hydraulic clutch system incorporating a master and slave piston and cylinder assembly, with the master piston and cylinder assembly being operatively associated with the clutch operating pedal and the slave piston and cylinder assembly being operatively associated with the clutch operating or actuating mechanism of a vehicle.

It is a more particular object of the present invention to provide a new and improved master-slave hydraulic clutch system wherein the master and slave piston and cylinder assemblies utilize common components whereby to simplify assembly and maintenance, and minimize ancillary inventory and replacement costs.

It is another object of the present invention to provide a new and improved hydraulic clutch system of the above described type which automatically compensates for changes in the volume of the hydraulic fluid due to expansion and contraction thereof.

It is a further object of the present invention to provide a new and improved hydraulic clutch system of the above character which is self-purging so as to eliminate air bubbles or the like which might tend to decrease the efficiency of operation thereof.

It is yet another object of the present invention to provide a new and improved hydraulic clutch system of the above described type wherein the purging will occur without exposing the hydraulic fluid of the system to the atmosphere, whereby to minimize the possibility of fluid contamination.

It is another object of the present invention to provide a new and improved master-slave hydraulic clutch system which utilizes cylinder housings of strong structural integrity, whereby the cylinders can support large bending moments and thereby simplify connecting linkages and associated structural members normally required for operatively connecting the master and slave units to the respective operating components of the associated vehicle.

It is a further object of the present invention to provide a new and improved hydraulic clutch system which incorporates simple mounting features, whereby to minimize installation time to the extreme.

It is yet a further object of the present invention to provide a new and improved hydraulic clutch system that is operable as an "up-stop" for the associated clutch actuating pedal..

It is still another object of the present invention to provide a new and improved hydraulic clutching system of the above described type which is of a relatively simple design, is economical to produce and will have a long and effective operational life.

Other objects and advantages of the present invention will become apparent from the following detailed description taken in conjunction with the accompanying drawings.

DETAILED DESCRIPTION OF THE PREFERRED EMBODIMENTS

Figure 1:
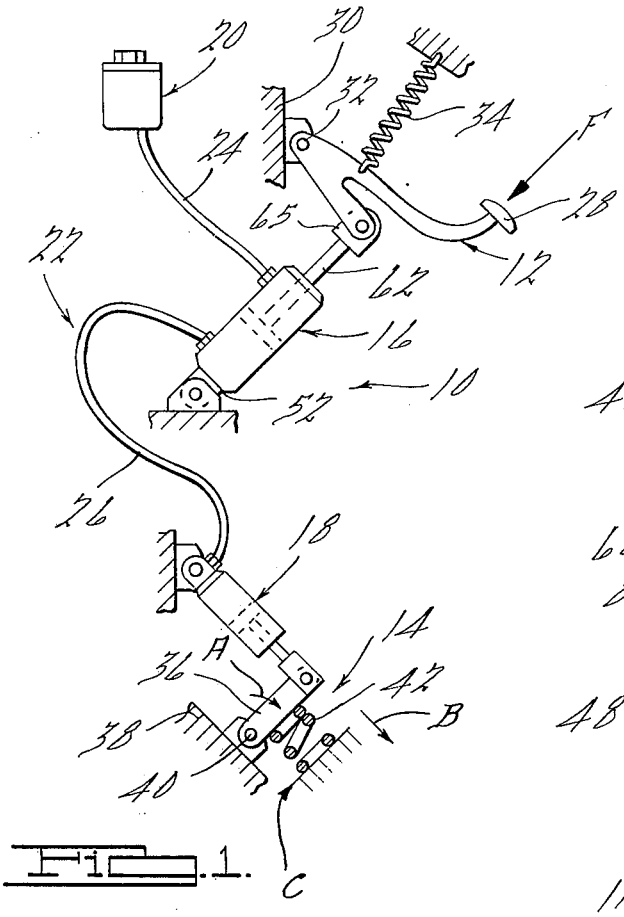
FIG. 1 is a schematic representation of a hydraulic clutch system incorporating the principles of the present invention.

Referring now in detail to the drawings and in particular to FIG. 1 thereof, a hydraulic clutch system 10, in accordance with one preferred embodiment of the present invention, is shown in operative association with certain operating components of a clutch operated vehicle, such as a foot operated clutch pedal 12 and a remotely located clutch operating or actuating mechanism, generally designated by the numeral 14. As will hereinafter be described in detail, the cluch system 10 of the present invention incorporates a pair of substantially identical master and slave piston and cylinder units 16 and 18, respectively, that function to effect actuation of the mechanism 14 in response to application of an operator applied force in the direction of the arrow F in FIG. 1 against the clutch pedal 12. The piston and cylinder units 16, 18 are operatively associated with a hydraulic fluid reservoir 20 and are connected by means of a fluid circuit 22 consisting of a first conduit 24 fluid communicating the reservoir 20 with the piston and cylinder unit 16 and a second fluid conduit 26 operatively connecting the units 16 and 18.

As best seen in FIG. 1, the clutch pedal 12 incorporates a foot engaging portion 28 and is pivotally connected to a suitable fixed portion 30 of the associated vehicle by means of a suitable pivot pin or hinge arrangement 32. The pedal 12 is provided with a return spring 34 that functions to cause the pedal 12 to be automatically biased to its normal deactuated position at such time as the pressure in the direction of the arrow F against the foot engaging portion 28 is decreased or relieved. The piston and cylinder unit 18 is operatively associated with a suitable actuating linkage 36 that is pivotally connected to a suitable fixed portion 38 of the vehicle by means of a pivot pin or the like 40. Additionally, a return spring 42 is associated with the linkage 36 for causing the linkage 36 to be biased or pivoted about the axis of the pin 40 in a direction opposite that shown by the arrow A in FIG. 1. As will be described in detail, at such time as the clutch pedal 12 is depressed or is pivoted in a clockwise direction in FIG. 1, the piston and cylinder unit 16 will be actuated, resulting in concomitant actuation of the unit 18, whereupon the connecting linkage 36 will be biased or pivoted in a clockwise direction in FIG. 1, causing the spring 42 to exert a clutch actuating force in the direction of the arrow B in FIG. 1 against the clutch actuating element representatively designated by the letter C. At such time as the pedal force F is relieved, the return springs 42 and 34 will urge the units 16, 18 to their respective deactuated position, as well as returning the pedal 12 to its normal deactuated position.

By virtue of the fact that the master and slave units 16 and 18 are identical in construction, for purposes of brevity of description, a detailed description of only the piston and cylinder unit 16 will be given, it being appreciated that identical components are incorporated in the unit 18, as will be apparent in connection with the description of the overall operation of the hydraulic clutch system 10 of the present invention.

Figure 2:
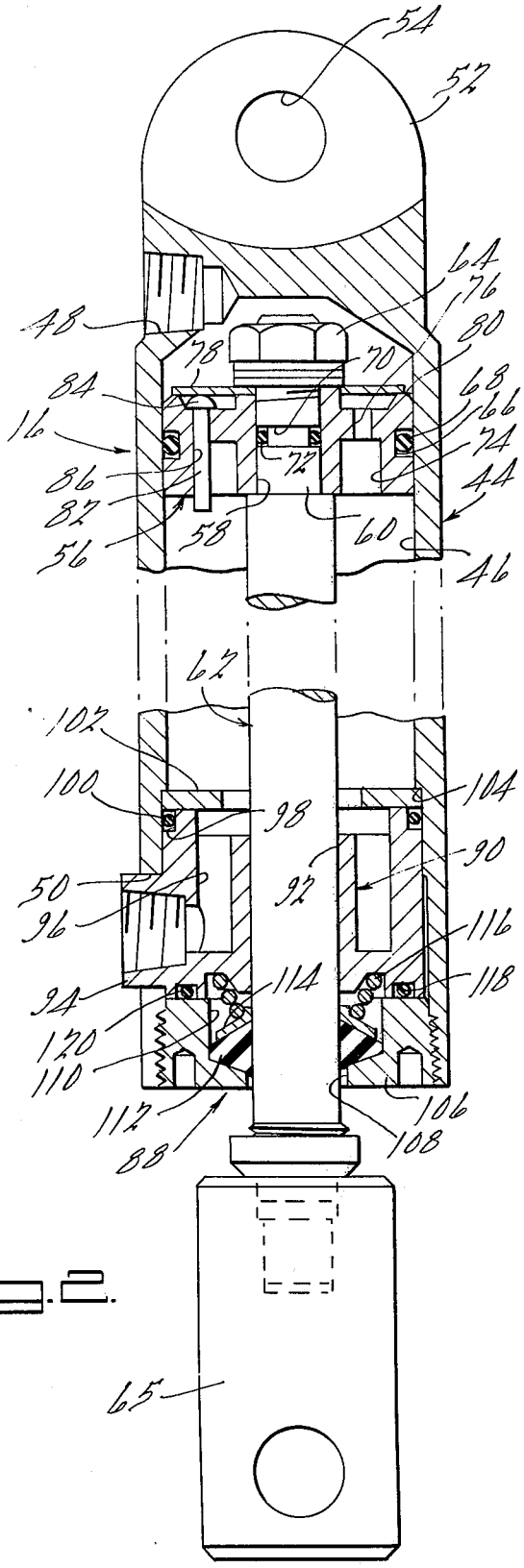
FIG. 2 is an enlarged transverse cross sectional view of one of the master-slave piston and cylinder units incorporated in the hydraulic clutch system shown in FIG. 1.

Referring now in detail to the construction of the piston and cylinder unit 16, as best seen in FIG. 2, the unit 16 comprises an elongated cylindrical housing 44 having an enlarged thickness outer wall defining an internal chamber 46. The housing 44 is formed with a pair of axially spaced radial openings 48 and 50, the former of which is internally threaded and adapted to threadably receive a suitable fluid fitting for operatively connecting the unit 16 with the conduit 22 and hence with the unit 18. The housing 44 includes an integral end wall providing an attachment means 52 having a suitable bore or opening 54 formed therein through which a suitable pivot pin or the like may extend to permit pivotal movement of the unit 16 relative to an associated mounting portion of the associated vehicle.

Disposed within the chamber 46 is a reciprocable piston 56 which is formed with a central axially extending bore 58 through which a reduced diameter end portion 60 of elongated piston rod 62 extends. Means in the form of a suitable retaining nut or the like 64 is threadably received on the end of the piston rod portion 60 for securing the piston 56 on the rod 62. The piston rod 62 extends axially of the housing 44 and the outer end thereof is provided with suitable attachment means, representativly designated by the numeral 65, for pivotally securing the end of the rod 62 to the clutch pedal 12. In the case of the unit 18, the attachment means 65 is pivotally connected by means of a suitable pivot pin or the like to the linkage 36, as will be apparent. As best seen in FIG. 2, the piston 56 is formed with an annular peripheral groove or recess 66 within which an O-ring sealing element 68 is disposed for providing a fluid tight sliding seal between the outer periphery of the piston 56 and the inner periphery of the chamber 46. A similar annular recess 70 is formed around the outer periphery of the reduced diameter portion 60 of the piston rod 62 and is adapted to nestingly receive a suitable O-ring sealing element 72 which functions to provide a fluid tight seal between the piston 56 and piston rod 62. The side of the piston 56 facing the piston rod 62 is formed with an annular cavity 74 which is communicable via one or more axially extending flow ports 76 with the opposite side of the piston 56. The flow ports 76 are normally blocked by a generally radially disposed valve disc 78, the inner periphery of which is clampingly secured to the piston 56 by the retaining nut 64, with the outer periphery of the disc 78 being adapted to engage an annular valve seat 80 formed around the adjacent side of the piston 56. The valve disc 78 is adapted to be selectively biased to an open position by means of a valve actuating pin 82 which extends axially of the piston 56 and is provided with an enlarged diameter head portion 84 engageable with the underside of the valve disc 78. As shown in FIG. 2, the actuating pin 82 is slidably supported within a suitable bore or opening 86 that extends axially of the piston 56, with the end of the pin 82 opposite the head portion 84 thereof extending axially outwardly from the piston 56 and funtioning in the manner hereinafter to be described. As will be apparent, at such time as the actuating pin 82 is biased axially upwardly relative to the piston 56 in FIG. 2, the adjacent portion of the valve disc 78 will be biased upwardly away from engagement with the valve seat 80, whereby to permit fluid communication from the underside of the piston 56 to the opposite or upper side thereof.

Figure 3:
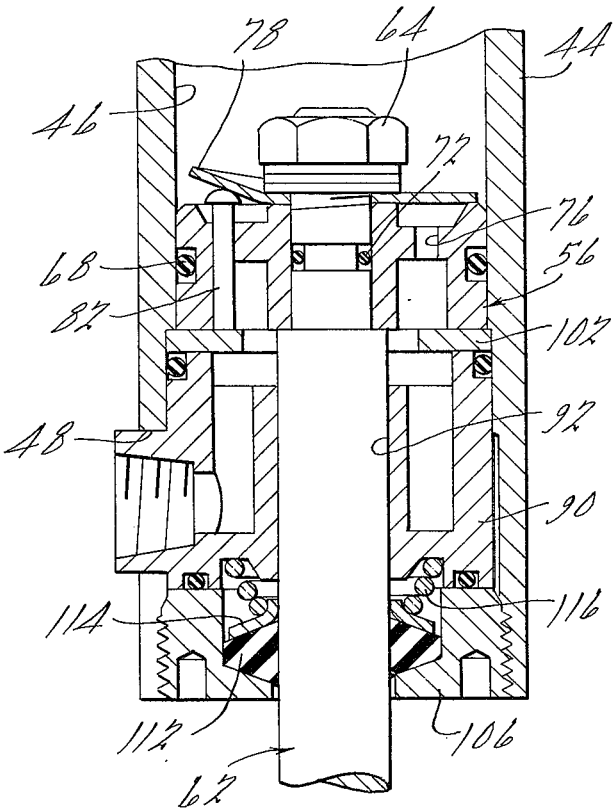
FIG. 3 is an enlarged fragmentary cross sectional view of a portion of the structure shown in FIG. 2.

The piston rod 62 is slidably or reciprocally supported within the housing 44 by means of a rod guide assembly, generally designated by the numeral 88. The assembly 88 comprises an annular rod guide member 90 which is secured within the open end of the chamber 46 and is formed with a central axially extending bore 92 through which the piston rod 62 extends. The rod guide member 90 includes an inlet fitting portion 94 which extends outwardly through the opening 50 and is internally threaded and adapted to receive a suitable fluid fitting or the like (not shown) for connecting the housing 44 with the conduit 24 and hence with the reservoir 20. Note that in the case of the piston and cylinder unit 18, the inlet fitting portion 94 is closed by means of a suitable threadably mounted fluid plug (not shown). The portion 94 is communicable with a suitable flow passage 96, whereby fluid may be communicated from the conduit 24 into the interior of the chamber 46. The outer periphery of the inner end of the rod guide member 90 is formed with annular recess 98 within which O-ring sealing element 100 is located, the element 100 providing a fluid tight seal between the outer periphery of the rod guide member 90 and the inner periphery of the housing 44. An annular abutment ring 102 is disposed between the inner end of the rod guide member 90 and an annular shoulder 104 formed around the inner periphery of the housing 44, the abutment ring 102 extending radially inwardly to a position circumjacent the piston rod 62 and is adapted for engagement with the end of the actuating pin 82 opposite the head portion 84 thereof upon outward movement of the piston rod 62 and piston 56, as best seen in FIG. 3. The abutment ring 102 and rod guide member 90 are retained within the end of the housing 44 by means of a threadably mounted retaining nut 106 which is formed with a central bore 108 through which the piston rod 62 extends. The bore 108 is formed with a counterbore 110 on the inner side thereof within which a suitable elastomeric fluid seal 112 is located, the seal 112 being adapted to slidably and sealingly engage the outer periphery of the piston rod 62. The seal 112 is urged into sealing engagement with the piston rod 62 by means of an annular spring retainer 114 and a conical sealing spring 116, one axial end of which bears against the retainer 114 and the opposite axial end of which is received within an annular recess 118 formed on the outer end of the rod guide member 90, a suitable fluid seal being provided between the outer end of the rod guide 90 and the retaining nut 106 by means of an O-ring sealing element 120 disposed therebetween.

In operation of the hydraulic clutch system 10 of the present invention, at such time as it is desired to effect actuation of the vehicle clutch, a vehicle operator will apply a force in the direction of the arrow F to the clutch pedal 12, resulting in clockwise pivotal movement of the pedal 12 and downward movement of the piston rod 62 relative to the housing 44 of the piston and cylinder unit 16. When this occurs, the piston 56 within the unit 16 will be biased downwardly, thereby causing fluid to be displaced from the lower end of the housing 44 of the unit 16 through the conduit 26. This fluid will in turn be introduced into the upper end of the housing 44 of the piston and cylinder unit 18, whereupon the piston 46 in the unit 18 will be biased downwardy in FIG. 1. Such downward movement of the piston 56 of the unit 18 will cause the piston rod 62 associated therewith to effect pivotal rotation or movement of the linkage 36 in a clockwise direction or in the direction of the arrow A in FIG. 1, whereupon an actuating force will be applied via the spring 42 against the clutch actuating structure C, resulting in actuation of the associated vehicle clutch. At such time as the vehicle operator relieves the force F applied to the brake pedal 12, the return springs 42 and 34 will cause the pistons 56 and piston rods 62 associated therewith within the units 16, 18 to move upwardly, with upward morement of the piston 56 within the unit 18 causing fluid to be displaced through the conduit 26 back into the lower end of the housing 44 of the unit 16. At such time as the piston 56 in the unit 16 is located in its fully upper position, the actuating pin 82 will engage the abutment ring 102, thereby communicating the interior of the chamber 46 via the conduit 24 with the reservoir 20. Accordingly, in the event there is an excess quantity of fluid in the system due to expansion thereof, such excess fluid may be communicated to the reservoir 20, and in the event there is a decrease in the quantity of the fluid in the system, such fluid will be replenished by the fluid which is stored within the reservoir 20. Of course, at such time as the hydraulic system 10 is again actuated due to depressing the clutch pedal 12, the piston 56 will be biased away from the abutment ring 102, with the result that the natural resilience of the valve disc 78 will cause the pine to be displaced axially within the bore 86 sufficient to permit closing of the valve disc 78 against the valve seat 80 to block further communication between the interior of the chamber 46 of the housing 44 with the reservoir 20.

Figure 4:
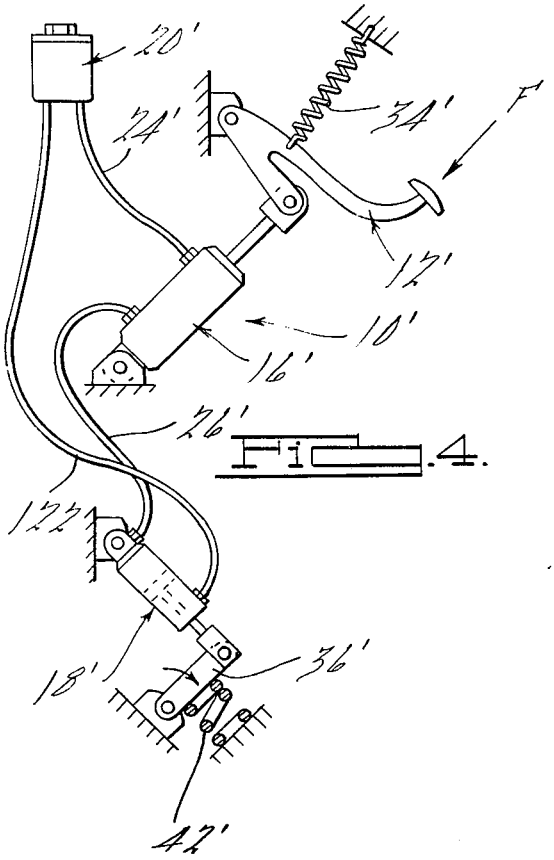
FIG. 4 is a view similar to FIG. 1 and illustrates an alternate hydraulic clutch system of the present invention.

FIG. 4 illustrates a slightly modified embodiment of the present invention wherein a hydraulic clutch system 10' is shown as consisting of identical components to the system shown in the system 10 and identified by like numerals with a prime suffix. The hydraulic clutch system 10' differs from the system 10 in that the reservoir 20' is not only connected with the piston and cylinder unit 16'0 via the conduit 24', but is also connected via a conduit 122 with the inlet fitting portion 94' of the rod guide assembly 88' associated with the piston and cylinder unit 18'. With this arrangement, at such time as the clutch pedal 12' and linkage 36' move to their normal at rest position under the influence of the return springs 34' and 42', the valve discs 78' (not shown) within each of the units 16' and 18' will be biased under the influence of the respective actuating pins 82' (not shown) to an open position so that at the end of each clutch operating cycle, the interior of the chamber 46 of each housing 34 will be communicated with the reservoir 20' so that complete purging of the fluid circuit may take place, with the result that any air bubbles or the like within the field circuit will be passed to the reservoir 20' so as to not detract from the effective operation of the piston and cylinder units 16' and 18'. A particularly important feature of the present invention will be seen from the fact that the aforementioned purging may take place without exposing the fluid to the atmosphere so that the possibility of fluid contamination is minimized to the extreme. Another feature of the present invention will be seen from the fact that the sidewalls of the housing 44 of the piston and cylinder units 16, 18, are of an extremely rugged construction and as such, the housing(s) 44 are operable to support large bending moments so as to minimize the complexity of the associated connecting linkages used for operatively connecting the units 16, 18 with the clutch pedal 12 and clutch actuating structure C. Of course, another extremely important feature of the present invention resides in the fact that the units 16, 18 are essentially identical in construction and hence the number of different component parts required for the systems 10 and 10' is minimized as great as possible so as to reduce the economies of production, inventorying, etc.

While it will be apparent that the preferred embodiments illustrated herein are well calculated to fulfill the objects above stated, it will be appreciated that the present invention is susceptible to modification, variation and change without departing from the scope of the invention.

I claim:

1. A hydraulic actuating system comprising, a first piston and cylinder assembly including means for causing a first piston to move within a first enclosure in response to actuation of a controller member, a second piston and cylinder assembly including a second piston movable within a second enclosure from a non-actuated position to an actuated position to operate a controlled member, said first and second piston and cylinder assemblies being of substantially identical construction, means for causing said first piston to move toward one end of said first enclosure and yieldable to permit said first piston to move toward the opposite end of said first enclosure upon actuation of said controller member.

fluid circuit means including conduit means communicating fluid from said one end of said first enclosure to said second enclosure for biasing said second piston from said nonactuated position towards said actuated position, a fluid reservoir communicable with said fluid circuit, normally closed valve means operative in response to preselected movement of said pistons within the associated of said enclosures toward said nonactuated positions to open and thereby communicate said reservoir with said circuit means, and spring means associated with said system and operable to cause said pistons to move toward said nonactuated positions and thereby effect automatic opening of said valve means upon de-actuation of said controller member.

2. The invention as set forth in claim 1 which includes a pair of flow ports located at axially spaced positions in said first enclosure.

3. The invention as set forth in claim 2 wherein said valve means comprises a flow passage in said piston, and a valve disc normally disposed in a position closing said flow passage and movable toward a position opening said passage.

4. The invention as set forth in claim 3 which includes a valve actuating pin for moving said valve disc to said position opening said flow passage.

5. The invention as set forth in claim 4 wherein said valve actuating pin is carried on said piston and is engageable with a relatively fixed portion of said enclosure upon preselected longitudinal movement of said piston within said enclosure.

6. The invention as set forth in claim 5 wherein said first piston and cylinder assembly comprises a piston rod connected to said first piston and reciprocable longitudinally therewith within said first enclosure, and which further includes valve means on said first piston, which includes a pair of flow ports located at the opposite ends of said first enclosure, wherein said valve means comprises a flow passage in said piston, and a valve disc normally disposed in a position closing said flow passage and movable toward a position opening said passage, and which includes a valve actuating pin for moving said valve disc to said position opening said flow passage.

7. The invention as set forth in claim 1 wherein each of said piston and cylinder assemblies comprises a piston rod movable between an extended and a retracted position, wherein each of said piston and cylinder assemblies includes valve means on said piston and valve opening means for opening and closing said valve means in response to movement of the associated of said pistons.

8. The invention as set forth in claim 7 wherein each of said enclosures comprises a pair of flow ports at the opposite ends thereof.

9. The invention as set forth in claim 8 which includes first conduit means for communicating one end of one of said enclosures with one end of the other of said enclosures, second conduit means communicating the opposite end of said first enclosure with said reservoir and third conduit means communicating said reservoir with the opposite end of said second enclosure.

10. The invention as set forth in claim 8 which includes first conduit means communicating one end of said first enclosure with said reservoir and second conduit means communicating the opposite end of said first enclosure with one end of said second enclosure.

11. A piston and cylinder unit for use in a master-slave actuating system having a fluid reservoir and a remote operating unit, said assembly comprising an elongated fluid cylinder, a piston reciprocably disposed within said cylinder, a piston rod extending longitudinally from one end of said cylinder and connected at one end thereof to said piston, means connecting one end of said unit to a controller member, normally closed valve means on said piston for communicating hydraulic fluid from one side thereof to the opposite side thereof, valve opening means for selectively opening said valve means in response to preselected longitudinal movement of said piston within said cylinder, fluid passage means for fluid communicating one side of said piston with said reservoir and the opposite side of said piston with said remote operating unit spring means associated with said system and operable to automatically cause said piston to move toward a position wherein said valve opening means opens said valve means upon de-actuation of said system.

12. The invention as set forth in claim 11 which includes two piston and cylinder assemblies in said system, said assemblies being of substantially identical construction and operation.

13. The invention as set forth in claim 12 which includes a fluid reservoir in said system.

14. The invention as set forth in claim 11 wherein said valve opening means includes a valve actuating pin carried on said piston and engageable with a relatively fixed portion of said cylinder upon preselected longitudinal movement of said piston within said cylinder.

15. The invention as set forth in claim 13 which includes a fluid reservoir, first conduit means communicating one end of said cylinder with said reservoir and second fluid conduit means communicating the other end of said cylinder with an associated piston and cylinder assembly which is substantially identical in construction and operation to said first mentioned piston and cylinder assembly.

* * * * *